United States Patent [19]

Davenport et al.

[11] 3,996,493

[45] Dec. 7, 1976

[54] FLUORESCENT LAMP UNIT HAVING BALLAST RESISTOR

[75] Inventors: John M. Davenport, Euclid; Elmer G. Fridrich, Cleveland, both of Ohio

[73] Assignee: General Electric Company, Schenectady, N.Y.

[22] Filed: July 28, 1975

[21] Appl. No.: 599,522

[52] U.S. Cl. ..... 315/58; 240/9 A; 240/51.11 R; 315/71; 315/94; 315/112; 315/DIG. 5

[51] Int. Cl.[2] ..... H01J 61/56

[58] Field of Search ..... 315/50, 58, 59, 71, 315/94, 100, 112, 113, 115, 246, 261, DIG. 5; 240/9 A, 51.11 R; 339/52 R

[56] References Cited

UNITED STATES PATENTS

| | | | |
|---|---|---|---|
| 2,056,635 | 10/1936 | Wiegand | 315/58 |
| 2,087,759 | 7/1937 | Gaidies | 315/58 |
| 2,344,122 | 3/1944 | Bay et al. | 315/49 |
| 2,344,160 | 3/1944 | Meese et al. | 240/31 |
| 3,179,794 | 4/1965 | Waly | 240/51.11 R |
| 3,714,492 | 1/1973 | Roche | 315/105 X |
| 3,753,036 | 8/1973 | Roche | 315/60 |

*Primary Examiner*—Eugene La Roche
*Attorney, Agent, or Firm*—Norman C. Fulmer; Lawrence R. Kempton; Frank L. Neuhauser

[57] ABSTRACT

An integral self-contained fluorescent lamp unit comprising an elongated lamp and an elongated ballast resistor carried in an outwardly extending housing member positioned alongside the lamp.

18 Claims, 4 Drawing Figures

FLUORESCENT LAMP UNIT HAVING BALLAST RESISTOR

CROSS-REFERENCES TO RELATED APPLICATIONS

U.S. patent application Ser. No. 599,521, John H. Campbell, filed concurrently herewith, "Fluorescent Lamp Unit for Multiple Installation", assigned the same as this invention.

U.S. patent application Ser. No. 599,523, Elmer G. Fridrich, filed concurrently herewith, "Fluorescent Lamp Unit", assigned the same as this invention.

BACKGROUND OF THE INVENTION

The invention is in the field of gas discharge lamp units, such as fluorescent lamp units.

Gas discharge lamps, such as fluorescent lamps, comprise an elongated bulb which may be straight or curved and which contains discharge electrodes near the ends thereof and also contains a suitable gas such as mercury. A ballast must be provided for limiting the discharge current in the lamp, and "preheat" lamp circuits conventionally contain a starting switch for causing heating of the electrode filaments prior to starting of the discharge.

The above-referenced Campbell patent application discloses a compact unitary permanently assembled gas discharge lamp unit having a ballast resistor and other conductors extending alongside and adjacent to an elongated discharge lamp, and electrical connectors permanently attached to the ends of the lamp and provided with terminals so that a plurality of lamps can be connected together, end to end.

SUMMARY OF THE INVENTION

Objects of the invention are to provide an improved discharge lamp unit of the type having a ballast resistor extending alongside and adjacent to an elongated discharge lamp, and to provide a construction for such a unit that is feasible and economical to manufacture, and which has an attractive appearance.

The invention comprises, briefly and in a preferred embodiment, an elongated discharge lamp, and an elongated ballast resistor positioned in an outwardly extending housing member positioned alongside the lamp. Preferably, the ballast resistor comprises resistance wire arranged in a zigzag manner, or wound in the form of a helix having a rectangular cross section of considerably greater width than thickness, to facilitate radiation of heat into surrounding space. The ballast resistor may comprise two resistors connected in electrical parallel for achieving more effective heat dissipation, and may be respectively positioned in a pair of outwardly extending wings of a housing member extending alongside the lamp. A starting conductor or stripe can be carried in the housing, and can function as a connection to a starting switch.

DESCRIPTION OF THE PREFERRED EMBODIMENTS

Figure 1:
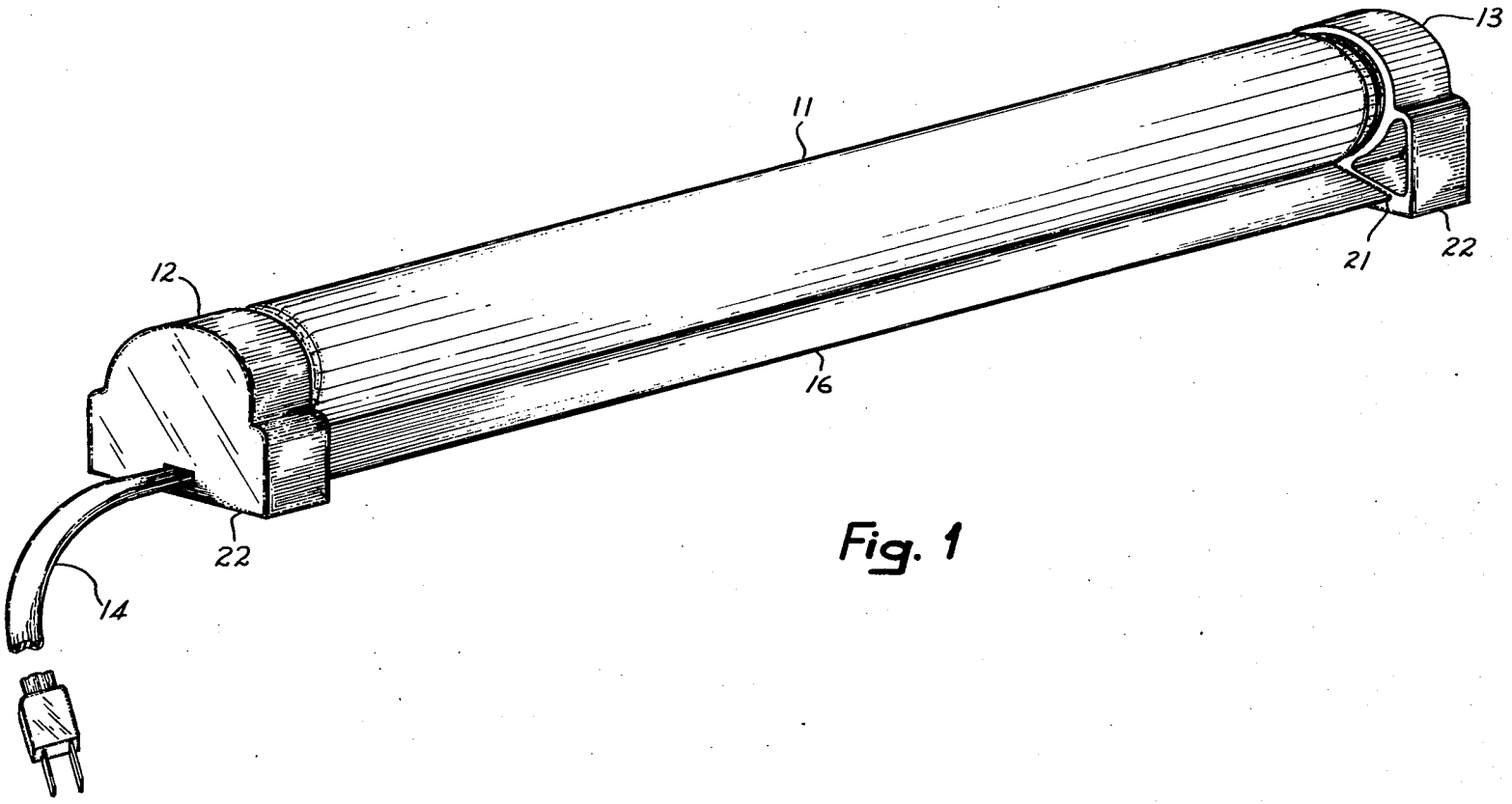
FIG. 1 is a perspective view of a fluorescent lamp discharge unit in accordance with a preferred embodiment of the invention.

In FIG. 1, an elongated gas discharge lamp 11 such as a fluorescent lamp is provided with end caps 12 and 13 permanently attached to the ends thereof. An electrical power connector cord 14 extends from one of the end caps 12. A ballast resistor and other desired conductors (which are not shown in FIG. 1) extend alongside and adjacent to the lamp 11. The arrangement thus far described is generally similar to that disclosed in the above-referenced Campbell patent application.

Figure 3:
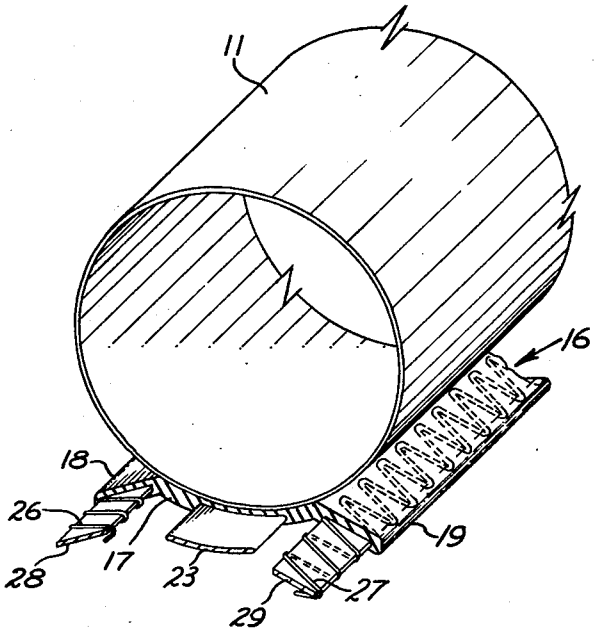
FIGS. 2 and 3 are perspective sectional views of alternative preferred embodiments of the lamp unit of FIG. 1.
Figure 2:
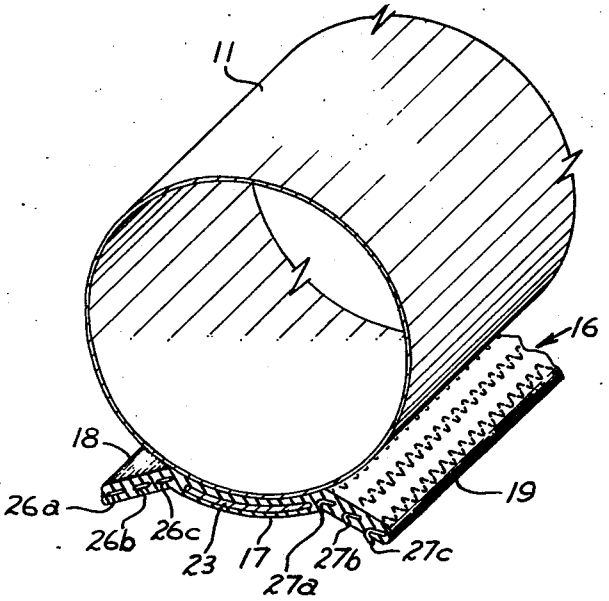

In accordance with the present invention, the ballast resistor and other conductors, required for operation of the discharge lamp 11, are carried in a shallow elongated housing member 16 extending alongside and adjacent to the lamp 11 between the end caps 12 and 13. Preferably, the housing 16 has a central region 17 which is contoured to fit snugly against a portion of the circumference of the circular tubular bulb of the lamp 11, as shown in FIGS. 2 and 3, and the sides thereof extend away from the lamp 11 in the form of wings 18 and 19. Preferably, the ends of the housing 16 fit into slots 21 in the end caps 12 and 13, which are shaped to the cross-sectional shape of the housing 16. The end caps 12 and 13 may be adhesively or otherwise attached to the ends of the lamp 11. The ends of the housing 16 projecting into the recesses 21 of the end caps may be adhesively or otherwise attached therein, and the center region 17 of the housing 16 which is in engagement with the lamp 11 may be adhesively or otherwise attached thereto, to form a unitary permanently assembled lamp unit. Flat mounting surfaces 22 may be provided on the sides of the end caps 12 and 13, lying in a common plane extending alongside the length of the lamp 11, to function as mounting means for attaching the lamp unit to a surface. The housing 16 is positioned to be in alignment with the flat mounting surfaces 22, so that when the lamp is mounted on a surface the housing 16 will not substantially adversely affect the useful light output of the lamp unit. Preferably, the housing member 16 is made of plastic material.

In the embodiment of FIG. 2, the housing 16 contains an elongated conductor in the form of a strip 23 of metal, such as aluminum foil, extending substantially from end to end of housing 16 in the central region 17. This conductor functions to aid in starting of the lamp, and may also function as a connection to a starting switch, as will be described.

In accordance with the invention, the housing member 16 contains or carries therein a ballast resistor in the form of two elongated resistor members 26, 27 in the wings 18 and 19, respectively, and they may comprise nichrome or other resistance wire wound helically around plastic supports 28, 29 as shown in FIG. 3, or may have a zigzag configuration as shown in FIG. 2. The housing 16 may be made of a plastic such as "Noryl" which is sufficiently heat conductive for a sufficient amount of heat to flow from the ballast resistor members 26, 27 into the surrounding space. At the same time, having sufficiently low thermal conductivity, the plastic housing 16 surrounding the resistor members 26, 27 does not feel unduly hot or painful when touched by a person, and the housing 16 also electrically insulates the metal strip 23 and ballast resistor members 26, 27 to prevent electrical shock to a person touching the lamp unit when it is operating.

In the embodiment of FIG. 2, the ballast resistor 26 comprises a plurality of individual zigzag resistor wires 26*a*, 26*b*, and 26*c* connected in electrical parallel, and the resistor 27 comprises a plurality of individual zigzag resistor wires 27*a*, 27*b*, and 27*c* connected in electrical parallel. Alternatively, each resistor can be a single wire arranged in a wide zigzag configuration. In either arrangement, the resistance wire has a large surface area for facilitating dissipation of heat generated therein, when the lamp unit is operating, through the thin wings 18, 19 and into surrounding space. The resistance wires can be molded in the plastic housing member 16, or can be embedded therein by ultrasonic vibration. In the embodiment of FIG. 3, the resistor support strips 28, 29 are considerably wider than thick, for example, at least three times as wide as thick, to provide large area heat-dissipating surfaces on the resistor unit to facilitate transfer of heat through the thin material of the wings 18, 19 and into surrounding space. If insufficient heat were radiated and dissipated from the ballast resistance, this heat would increase operating temperature of the lamp to above optimum value.

Figure 4:
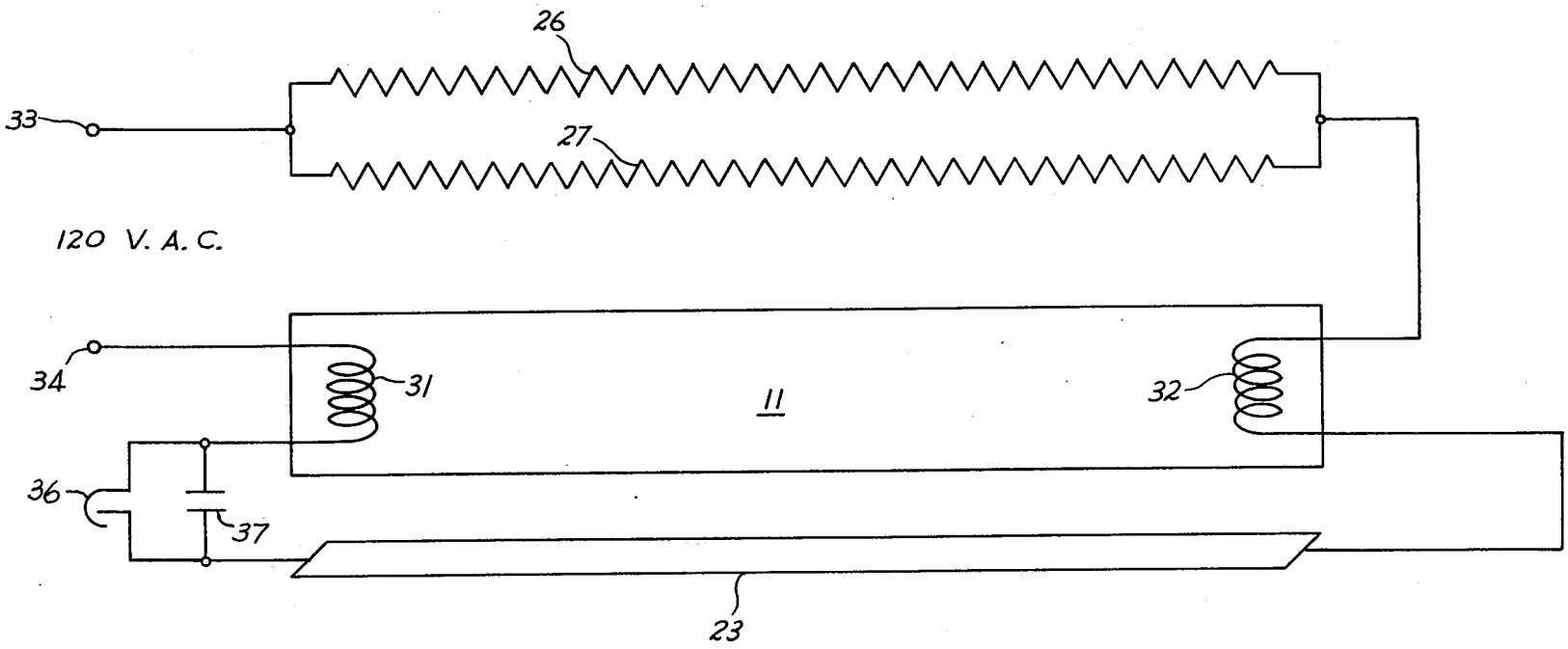
FIG. 4 is a preferred electrical schematic diagram of the lamp unit of FIG. 1.

In FIG. 4, the lamp 11 is provided with electrodes respectively near the ends thereof and conventionally comprising coiled filaments 31, 32, each coated with electron-emitting material. A pair of electrical power input terminals 33, 34 is provided, and they may be connected to or consist of a pair of wires in the connector power cord 14. The parallel-connected ballast resistors 26, 27 are connected between the input power terminal 33 and a first end of the filament 32, and the input power terminal 34 is connected to a first end of the filament 31. The metal starting strip 23 in connected electrically in series combination with a starter switch 36, this series combination being connected between the second ends of the filaments 31 and 32. A capacitor 37 is conventionally connected across the starter switch 36, which may be a conventional glow-starter switch. The switch 36 and capacitor 37 may be carried in one of the end caps 12, 13.

The circuit of FIG. 4 functions as follows. When electrical power is applied to the input terminals 33 and 34, current flows between them through the ballest resistor 26–27, filament 32, gas in the glow switch 36, the starter conductor 23, and filament 31. The gas glow in the switch 36 generates sufficient heat to cause a bimetal contact element to close the switch 36, whereupon sufficient current passes through the filaments 31 and 32, via the ballast resistor 26–27 and starter strip 23, to heat the filaments 31 and 32 sufficiently for then to emit electrons. After a few seconds of this preheating, the switch 36 opens and an arc discharge occurs in the lamp 11, in well-known manner. The starting of this discharge in the lamp 11, especially under high humidity conditions, is facilitated by the conductor 23, which is closely adjacent to the lamp 11, functioning as a starting stripe, in well-known manner. If the lamp 11 is a type, such as the "instant-start" type of lamp which does not require preheating of its filaments, the starter switch 36 and capacitor 37 can be eliminated, but it is desirable to incorporate the starting stripe 23, which may be electrically floating or connected to an end of one of the filaments. Thus, the metal strip 23 can function as either or both a starting stripe and a conductor for connecting the starter switch 36 into the circuit.

The invention has been found to achieve its objectives of providing a compact, slender, attractively styled discharge lamp unit, with an integral ballast resistor and operating conductors of the unit electrically insulated and encased in an unobtrusive and attractive housing, which housing is provided with one or more heat-radiating wings in which the ballast resistance is located. The housing 16 can have configurations other than that shown in the drawing. For example, it can be essentially flat and wide enough so that its side regions extend sufficiently outwardly from the lamp to function as heat radiator wings. In a preferred configuration, as shown in the drawing, the central region 17 of the housing 16 is curved to conform to the tubular shape of the lamp 11, and the wings 18 and 19 are sloped in a direction away from the lamp 11 and their edges are at or near the plane of the flat mounting surfaces 22 on the end caps 12, 13.

While preferred embodiments and modifications of the invention have been shown and described, various other embodiments and modifications thereof will become apparent to persons skilled in the art and will fall within the scope of the invention as defined in the following claims.

What we claim as new and desire to secure by Letters Patent of the United States is:

1. An integral self-contained gas discharge lamp unit comprising an elongated gas discharge lamp, a housing member positioned against and alongside said lamp and comprising a wing portion extending away from said lamp along the length thereof, and an elongated ballast resistor positioned embedded in said wing portion along the length thereof and connected electrically to ballast said lamp when operating, whereby heat generated in said ballast resistor when the lamp is operating will be dissipated from said wing portion into surrounding space.

2. A lamp unit as claimed in claim 1, in which said wing is a plastic material having said ballast resistor embedded therein.

3. A lamp unit as claimed in claim 1, in which said ballast resistor comprises a wire shaped in a zigzag configuration.

4. A lamp unit as claimed in claim 3, in which said ballast resistor comprises a plurality of wires each shaped in a zigzag configuration.

5. A lamp unit as claimed in claim 1, in which said ballast resistor comprises a wire wound helically around a strip of material.

6. A lamp unit as claimed in claim 5, in which said strip of material has a width of at least three times its thickness.

7. A lamp unit as claimed in claim 1, including an elongated electrical conductor carried by said housing member and extending alongside and adjacent to said lamp.

8. A lamp unit as claimed in claim 7, including a starting switch circuit connected to aid in starting said lamp, said electrical conductor being electrically connected to be a conductor in said starting switch circuit.

9. A lamp unit as claimed in claim 1, in which said housing member is relatively wider than thick and is shaped across its lateral dimension so as to have an elongated central region positioned against said lamp and a pair of side regions one of which comprises said wing and the other of which extends away from said lamp along the length thereof to form a second wing, said elongated ballast resistor being positioned in one of said wings, a second ballast resistor similarly positioned in the other of said wings, means connecting said ballast resistors in electrical parallel combination, and means connecting said parallel combination of ballast resistors electrically in series with said lamp.

10. A lamp unit as claimed in claim 9, in which each of said ballast resistors comprises a wire shaped in a zigzag configuration.

11. A lamp unit as claimed in claim 10, in which each of said ballast resistors comprises a plurality of wires each shaped in a zigzag configuration.

12. A lamp unit as claimed in claim 9, in which each of said ballast resistors comprises a wire wound helically around a strip of material.

13. A lamp unit as claimed in claim 9, including a pair of end caps attached respectively to the ends of said lamp, and means attaching the ends of said housing member to said end caps, respectively.

14. A lamp unit as claimed in claim 13, in which said means attaching the ends of the housing member to the end caps comprises slots in said end caps into which said ends of the housing member extend.

15. A lamp unit as claimed in claim 13, in which said end caps are provided with mounting surfaces on the sides thereof and in alignment with each other along a line parallel to the axis of said lamp, said housing member being substantially in alignment with and between said mounting surfaces.

16. A lamp unit as claimed in claim 9, including end caps attached respectively to the ends of said lamp, said enc caps being provided with flat mounting surfaces on the sides thereof, said mounting surfaces lying in a plane, and the outer edges of said wings being at or near said plane of the mounting surfaces.

17. A lamp unit as claimed in claim 9, including an elongated electrical conductor carried by said housing member and extending alongside and adjacent to said lamp.

18. A lamp unit as claimed in claim 17, including a starting switch circuit connected to aid in starting said lamp, said electrical conductor being electrically connected to be a conductor in said starting switch circuit.

* * * * *